US007170235B2

(12) United States Patent
Van Casteren

(10) Patent No.: US 7,170,235 B2
(45) Date of Patent: Jan. 30, 2007

(54) CIRCUIT ARRANGEMENT WITH A SEPARATE RESONANT IGNITER FOR A HIGH-PRESSURE DISCHARGE LAMP

(75) Inventor: Dolf Henricus Jozef Van Casteren, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 9 days.

(21) Appl. No.: 10/541,982

(22) PCT Filed: Dec. 5, 2003

(86) PCT No.: PCT/IB03/05824

§ 371 (c)(1),
(2), (4) Date: Jul. 11, 2005

(87) PCT Pub. No.: WO2004/064457

PCT Pub. Date: Jul. 29, 2004

(65) Prior Publication Data

US 2006/0113924 A1 Jun. 1, 2006

(30) Foreign Application Priority Data

Jan. 14, 2003 (EP) ..... 03075109

(51) Int. Cl.
*H05B 37/02* (2006.01)

(52) U.S. Cl. ..... 315/224; 315/225; 315/226

(58) Field of Classification Search ..... 315/209 R, 315/224, 225, 226, 244, 291, 276, 283, 284, 315/286, DIG. 7; 363/123, 131, 132
See application file for complete search history.

(56) References Cited

U.S. PATENT DOCUMENTS

| | | | | |
|---|---|---|---|---|
| 5,319,286 | A * | 6/1994 | Leyten | 315/224 |
| 5,742,132 | A * | 4/1998 | Huber et al. | 315/209 R |
| 5,962,981 | A * | 10/1999 | Okude et al. | 315/224 |
| 6,414,448 | B1 | 7/2002 | Durkan et al. | 315/291 |
| 6,426,597 | B2 * | 7/2002 | Rast et al. | 315/219 |
| 2001/0020830 | A1 | 9/2001 | Huber et al. | 315/172 |

FOREIGN PATENT DOCUMENTS

| | | |
|---|---|---|
| EP | 0411617 | 2/1991 |
| EP | 0595414 | 5/1994 |

* cited by examiner

*Primary Examiner*—Thuy Vinh Tran

(57) ABSTRACT

In a bridge circuit for operating a high pressure discharge lamp an additional switching element, a control circuit for driving the additional switching element, a resonant inductor and a resonant capacitor are incorporated. The additional components together form a comparatively simple resonant igniter. The resonant inductor can be formed by part of a filter comprised in the bridge.

12 Claims, 1 Drawing Sheet

Figure 1:
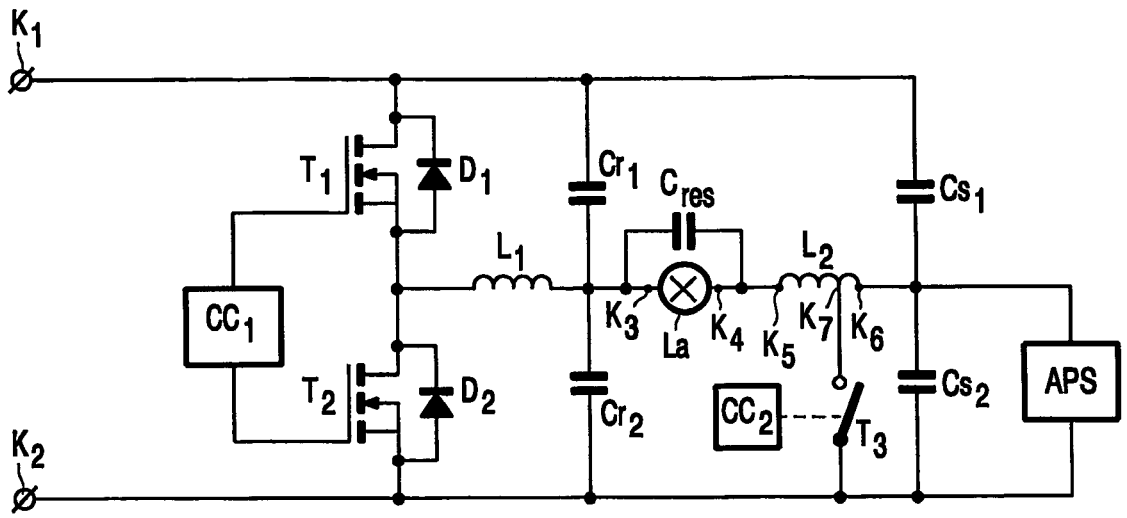

CIRCUIT ARRANGEMENT WITH A SEPARATE RESONANT IGNITER FOR A HIGH-PRESSURE DISCHARGE LAMP

This application is National Phase Application under 35 U.S.C. 371, claiming the benefit of PCT/IB03/05824 filed on Dec. 5, 2003, which has priority based on EPO Application No. 03075109.3, filed on Jan. 14, 2003.

The invention relates to a circuit arrangement for discharge lamp, equipped with a DC-AC-converter comprising input terminals for connection to a supply voltage source for supplying a first DC voltage, a first series arrangement of a first and a second switching element coupled between the input terminals, a first control circuit, coupled to respective control electrodes of the first and second switching element, for controlling the conductive state of the first and second switching element, a load circuit shunting one of the switching elements and comprising a first inductive element and terminals for lamp connection.

Such a circuit arrangement is well known. The DC-AC-converter is of the bridge type. During stationary operation of the lamp, the switching elements are controlled in such a way that the resulting lamp current is a low frequency substantially square wave shaped AC current. It has been found that such a current shape allows an efficient and dependable operation of the lamp. The known circuit is often equipped with a pulse igniter. The time lapse between successive pulses is generally so long that the lamp has to ignite under the influence of a single pulse since charge carriers in the lamp, generated by an ignition pulse have disappeared by the time the next ignition pulse is generated. Since the lamp has to ignite on a single ignition pulse, the amplitude and the width of this pulse need to be comparatively high. As a consequence the components making up the pulse igniter are bulky and expensive. An alternative possibility to ignite the lamp is to place a resonant capacitor in parallel with the lamp and render the first and second switching elements alternately conductive and non-conductive at a high frequency to thereby generate an AC voltage with a comparatively high amplitude over the lamp. However, for the voltage over the lamp to have a high enough amplitude, the bridge switches need to be operated at a frequency that is close to the resonance frequency of the load circuit of the DC-AC-converter. Furthermore, this requires that the first control circuit comprises additional circuitry to realize protection against capacitive operation. As a result the first control circuit becomes very complex.

The invention aims to provide a circuit arrangement for operating a high pressure discharge lamp comprising means for igniting the lamp that ensure an effective ignition of the lamp and are comparatively simple and small.

A circuit arrangement as mentioned in the opening paragraph is therefor according to the invention characterized in that the circuit arrangement is further equipped with a resonant capacitive element coupled between the terminals for lamp connection, a second inductive element coupled in series with the resonant capacitive element, a third switching element coupled between a terminal of the second inductive element and one of the input terminals, and a second control circuit coupled to a control electrode of the third switching element for rendering the third switching element alternatingly conductive and non-conductive with frequency f and thereby generating an AC ignition voltage over the resonant capacitive element.

The resonant capacitor, second inductive element, third switching element and the second control circuit together form a separate resonant igniter. It has been found that the lamp ignition can be realized in a dependable and effective way making use of this separate resonant igniter. Furthermore, the control circuitry comprised in the second control circuit can be comparatively simple.

Good results have been obtained for embodiments of a circuit arrangement according to the invention that are further equipped with an auxiliary power supply for supplying a second DC voltage, respective poles of the auxiliary power supply being coupled to respective main electrodes of the third switching element.

Good results have also been obtained for embodiments of a circuit arrangement according to the invention, wherein the second inductive element comprises a transformer equipped with a primary winding that is coupled between the third switching element and an input terminal and a secondary winding coupled in series with the terminals for lamp connection.

A very effective use of the second inductive element is achieved in embodiments of a circuit arrangement according to the invention, wherein part of the second inductive element is part of a filter comprised in the circuit arrangement.

In a first preferred embodiment of a circuit arrangement according to the invention, the first and second switching element either comprise a diode or are each shunted by a diode, the DC-AC converter comprises a half bridge circuit and the first control circuit is equipped with means for alternatingly at a low frequency operating the circuit arrangement in a first and a second operating state, wherein in the first operating state the first switching element is rendered conductive and non-conductive at a high frequency while the second switching element is maintained in a non-conductive state, and wherein in the second operating state the second switching element is rendered conductive and non-conductive at a high frequency while the first switching element is maintained in a non-conductive state. The first and second operating state correspond to a mode of operation of the circuit arrangement commonly referred to as "commutating forward operation". The commutating forward operation allows an effective control of the lamp current during stationary lamp operation.

In a second preferred embodiment the DC-AC-converter comprises a full bridge circuit equipped with a second series arrangement of a fourth and a fifth switching element that is coupled between the input terminals, and means comprised in the first control circuit coupled to control electrodes of the fourth and fifth switching element, for controlling the conductive state of the fourth and fifth switching element, and wherein the first control circuit is equipped with means for alternatingly at a low frequency operating the circuit arrangement in a first or a second operating state, wherein in the first operating state one of the switching elements in each of the series arrangements is maintained non-conductive while of the two remaining switching elements one is maintained conductive and the other is rendered conductive and non-conductive at a high frequency, and wherein in the second operating state one of the switching elements that were non-conductive in the first state is maintained conductive while the other is rendered conductive and non-conductive at a high frequency and the other two switching elements are maintained non-conductive, and wherein the switching elements, that are in series with those switching elements that are operated at a high frequency in one of the operating states, either comprise a diode or are each shunted by a diode. Also in this second preferred embodiment during the first and second operating state the circuit arrangement is operated in the commutating forward mode.

In case the third switching element is rendered conductive during each period of the ignition voltage the frequency of the AC ignition voltage equals the frequency f of the second control signal. In this case the amplitude of the AC ignition voltage is comparatively high and is constant. Alternatively the third switching element can be rendered conductive only once in every n periods of the ignition voltage, n being a natural number bigger than or equal to 2. In this latter case the average amplitude of the AC ignition voltage is lower and the frequency of the AC ignition voltage is n*f. During the periods of the AC ignition voltage in which the third switching element is not rendered conductive, the amplitude of the AC ignition voltage decreases exponentially. It has been found that good results are obtained when the frequency of the second control signal is chosen so that the amplitude of the AC ignition voltage is always bigger than half its maximum value.

After a high pressure discharge lamp has ignited, a short time interval follows during which the discharge in the lamp is stabilizing. This short time interval is usually referred to as the "take over" or "take over phase" of the lamp. During the take over the lamp voltage often changes randomly between high and low values. For this reason the circuit arrangement needs to be dimensioned so that it has a relatively high open circuit voltage. It has been found, however, that in case the second control circuit keeps rendering the third switching element conductive and non-conductive after ignition of the lamp, during take over, a good take over behavior could be realized, even when the circuit arrangement was not dimensioned to generate a high open circuit voltage. A good take over behavior means that after ignition the lamp does not extinguish but the discharge is maintained in the majority of ignition attempts, so that the lamp progresses through the take over and the run up phase to stationary operation. To realize such good take over behavior the second control circuit is preferably equipped with means for detecting the end of the take over phase. In the first part of the run-up phase following the take over phase, the lamp voltage is low and comparatively stable. Therefor the means for detecting the end of the take over phase can for instance comprise means for determining whether the lamp voltage has been higher than a predetermined value in a predetermined time interval. When no lamp voltage higher than the predetermined value is detected in the predetermined time interval the second control circuit switches off since the take over phase has passed and the lamp is in the run-up phase.

Embodiments of the invention will be explained making reference to a drawing. In the drawing FIG. 1 shows a first embodiment of a circuit arrangement according to the invention with a lamp connected to it, and FIG. 2 shows a second embodiment of a circuit arrangement according to the invention with a lamp connected to it.

Figure 2:
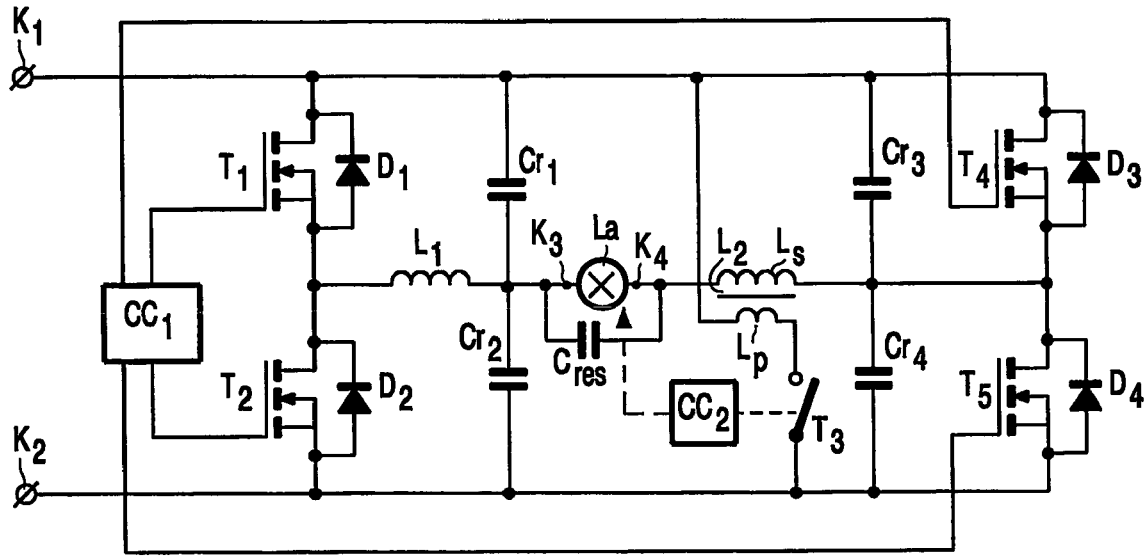

In FIG. 1, K1 and K2 are input terminals for connection to a supply voltage source for supplying a first DC voltage. Input terminals K1 and K2 are connected by means of a series arrangement of a first switching element T1 and a second switching element T2. The first switching element T1 is shunted by a diode D1 and the second switching element T2 is shunted by a diode D2. It is noted that in case the switching elements are for instance MOSFETS, they comprise internal diodes so that external diodes shunting the switching elements can be dispensed with. Circuit part CC1 forms a first control circuit for controlling the conductive state of the first switching element T1 and the second switching element T2. Respective output terminals of circuit part CC1 are connected to a control electrode of the first switching element T1 and to a control electrode of the second switching element T2. Input terminals K1 and K2 are also connected by a series arrangement of capacitors Cr1 and Cr2 and by a series arrangement of capacitors Cs1 and Cs2. A common terminal of the first switching element T1 and the second switching element T2 is connected to a common terminal of capacitors Cr1 and Cr2 by means of an inductor L1. In the embodiment shown in FIG. 1, inductor L1 forms a first inductive element. The common terminal of capacitors Cr1 and Cr2 is connected to a common terminal of capacitors Cs1 and Cs2 by means of a series arrangement of lamp connection terminal K3, high pressure discharge lamp La, lamp connection terminal K4 and inductor L2. Lamp connection terminals K3 and K4 are connected by means of a capacitor Cres. In the embodiment shown in FIG. 1, lamp connection terminals K3 and K4, capacitors Cres and Cs2 and inductors L1 and L2 together form a load circuit shunting the second switching element T2. Inductor L2 and capacitor Cres form a second inductive element and a resonant capacitive element respectively. Inductor L2 also forms a filter together with capacitors Cr1 and Cr2. Inductor L2 is an autotransformer and is equipped with a first terminal K5 at a first end of inductor L2 and connected to lamp connection terminal K4, a second terminal K6 at a second end of inductor L2 and connected to the common terminal of capacitors Cs1 and Cs2 and a third terminal K7 situated between the first terminal terminal K5 and the second terminal K6. A third switching element T3 is coupled between the third terminal K7 of inductor L2 and input terminal K2. Circuit part CC2 is a second control circuit for rendering the third switching element T3 alternatingly conductive and non-conductive with frequency f and thereby generating an AC ignition voltage over the capacitor Cres. An output terminal of circuit part CC2 is coupled to a control electrode of the third switching element T3. An input terminal of circuit part CC2 is coupled to the lamp La. In FIG. 1 both these couplings are indicated by means of a dotted line. Circuit part APS is an auxiliary power supply for supplying a second DC voltage. Circuit part APS shunts capacitor Cs2.

The operation of the circuit arrangement shown in FIG. 1 is as follows.

When the high pressure discharge lamp La is not yet ignited, circuit part CC2 renders the third switching element T3 alternatingly conductive and non-conductive with frequency f. As a consequence the auxiliary power supply APS causes an AC current to flow through inductor L2 and capacitor Cres and an AC ignition voltage to be present across the capacitor Cres. When this AC ignition voltage is maintained during a comparatively short time lapse, the high pressure discharge lamp will be ignited by it. After ignition of the lamp the circuit part CC2 keeps rendering the third switching element conductive and non-conductive with frequency f, so that a current through the lamp La with frequency f is generated. Additionally, the circuit part CC1 alternatingly at a low frequency controls the operation of the circuit arrangement in a first and a second operating state, wherein in the first operating state the first switching element T1 is rendered conductive and non-conductive at a high frequency while the second switching element is maintained in a non-conductive state, and wherein in the second operating state the second switching element T2 is rendered conductive and non-conductive at a high frequency while the first switching element is maintained in a non-conductive state. This operation is commonly referred to as commutating forward and as a result of this operation a low frequency substantially rectangular lamp current is generated. The filter formed by inductor L2 and capacitors Cr1 and Cr2 suppresses the interference that is generated by the high frequency ripple that is comprised in the lamp current. The second control circuit CC2 comprises circuitry for detecting whether the lamp voltage across the lamp La has been higher than a predetermined value in a predetermined time interval. When it is detected that the lamp voltage has not been higher than the predetermined value in the predetermined time interval, the second control circuit maintains the third switching element T3 in a non-conductive state. The lamp La is in the run-up phase and it is supplied only with the low frequency substantially rectangular current generated by the first control circuit CC1 and the first and second switching elements T1 and T2.

In FIG. 2 circuit parts and components that fulfil the same function as corresponding circuit parts and components in the circuit arrangement in FIG. 1 are labeled with the same references.

K1 and K2 are input terminals for connection to a supply voltage source for supplying a first DC voltage. Input terminals K1 and K2 are connected by means of a series arrangement of a first switching element T1 and a second switching element T2. The first switching element T1 is shunted by a diode D1 and the second switching element T2 is shunted by a diode D2. Circuit part CC1 forms a first control circuit for controlling the conductive state of the first switching element T1 and the second switching element T2. Respective output terminals of circuit part CC1 are connected to a control electrode of the first switching element T1 and to a control electrode of the second switching element T2. Input terminals K1 and K2 are also connected by a series arrangement of capacitors Cr1 and Cr2, by a series arrangement of capacitors Cr3 and Cr4 and by a series arrangement of a fourth switching element T4 and a fifth switching element T5. The fourth switching element T4 is shunted by a diode D3 and the fifth switching element T5 is shunted by a diode D4. Respective output terminals of circuit part CC1 are connected to a control electrode of the fourth switching element T4 and the fifth switching element T5. A common terminal of the first switching element T1 and the second switching element T2 is connected to a common terminal of capacitors Cr1 and Cr2 by means of an inductor L1. In the embodiment shown in FIG. 2, inductor L1 forms a first inductive element. The common terminal of capacitors Cr1 and Cr2 is connected to a common terminal of capacitors Cr3 and Cr4 and to a common terminal of the fourth switching element T4 and the fifth switching element T5 by means of a series arrangement of lamp connection terminal K3, high pressure discharge lamp La, lamp connection terminal K4 and a secondary winding Ls of transformer L2. Transformer L2 forms a second inductive element and comprises a primary winding Lp in addition to the secondary winding Ls. Lamp connection terminals K3 and K4 are connected by means of a capacitor Cres. In the embodiment shown in FIG. 2, lamp connection terminals K3 and K4, capacitor Cres, inductors L1 and L2 and fifth switching element T5 together form a load circuit shunting the second switching element T2. Inductor L2 and capacitor Cres form a second inductive element and a resonant capacitive element respectively. Inductor L1 forms a ballast choke during stationary operation of the circuit arrangement but also forms a filter together with capacitors Cr1 and Cr2. Similarly secondary winding Ls and capacitors Cr3 and Cr4 also form a filter. Input terminals K1 and K2 are also connected by means of a series arrangement of primary winding Lp and a third switching element T3. Circuit part CC2 is a second control circuit for rendering the third switching element T3 alternatingly conductive and non-conductive with frequency f and thereby generating an AC ignition voltage over the capacitor Cres. An output terminal of circuit part CC2 is coupled to a control electrode of the third switching element T3. An input terminal of circuit part CC2 is coupled to the lamp La. In FIG. 2 both these couplings are indicated by means of dotted lines.

The operation of the circuit arrangement shown in FIG. 2 is as follows. When the input terminals K1 and K2 are connected to a supply voltage source supplying a first DC voltage and the high pressure discharge lamp La has not yet ignited, circuit part CC2 renders the third switching element T3 alternatingly conductive and non-conductive with frequency f. As a consequence an AC current is caused to flow through secondary winding Ls and capacitor Cres and an AC ignition voltage is present across the capacitor Cres. When this AC ignition voltage is maintained during a comparatively short time lapse, the high pressure discharge lamp La will be ignited by it. After ignition of the lamp the circuitpart CC2 keeps rendering the third switching element conductive and non-conductive with frequency f, so that a current through the lamp La with frequency f is generated. Additionally, the circuit part CC1 alternatingly at a low frequency controls the operation of the circuit arrangement in a first and a second operating state, wherein in the first operating state the second switching element T2 and the fourth switching element T4 are maintained non-conductive while the fifth switching element T5 is maintained conductive and the first switching element T1 is rendered conductive and non-conductive at a high frequency, and wherein in the second operating state the first switching element T1 and the fifth switching element T5 are maintained non-conductive while the fourth switching element T4 is maintained conductive and the second switching element T2 is rendered conductive and non-conductive at a high frequency. This operation is commonly referred to as "commutating forward" and as a result of this operation a low frequency substantially rectangular lamp current is generated. The filter formed by secondary winding Ls of inductor L2 together with capacitors Cr3 and Cr4 also suppresses the interference caused by the high frequency ripple comprised in the lamp current. The second control circuit CC2 comprises circuitry for detecting whether the lamp voltage across the lamp La has been higher than a predetermined value in a predetermined time interval. When it is detected that the lamp voltage has not been higher than the predetermined value in the predetermined time interval, the second control circuit maintains the third switching element T3 in a non-conductive state. The lamp La is in the run-up phase and it is supplied only with the low frequency substantially rectangular current generated by the first control circuit CC1 and the first, second, fourth and fifth switching elements T1, T2, T4 and T5.

The AC ignition voltage generated in the circuit arrangement shown in FIG. 1 or the circuit arrangement shown in FIG. 2 generally has a frequency that is approximately equal to the resonance frequency of the inductor L2 and the capacitor Cres. The circuit arrangements are so designed that the resonance frequency of inductor L2 and capacitor Cres is a multiple of the frequency f of the control signal generated by the second control circuit (circuit part CC2). In case the third switching element T3 is rendered conductive during part of each period of the AC ignition voltage, the amplitude of the AC ignition voltage is constant and comparatively high. In case the third switching element T3 is rendered conductive only once in every n periods of the ignition voltage, n being a natural number bigger than or equal to 2, the average amplitude of the AC ignition voltage is lower and the frequency of the AC ignition voltage is n*f. During the periods of the AC ignition voltage in which the third switching element is not rendered conductive the amplitude of the AC ignition voltage decreases exponentially. In this latter case the average amplitude of the AC ignition voltage can be chosen so as to match the value required by a certain high pressure discharge lamp.

The invention claimed is:

1. Circuit arrangement for operating a high pressure discharge lamp, equipped with a DC-AC-converter comprising input terminals for connection to a supply voltage source for supplying a first DC voltage, a first series arrangement of a first and a second switching element coupled between the input terminals, a first control circuit, coupled to respective control electrodes of the first and second switching element, for controlling the conductive state of the first and second switching elements, a load circuit shunting one of the switching elements and comprising a first inductive element and terminals for lamp connection, characterized in that the circuit arrangement is further equipped with a resonant capacitive element coupled between the terminals for lamp connection, a second inductive element coupled in series with the resonant capacitive element, a third switching element coupled between a terminal of the second inductive element and one of the input terminals, and a second control circuit coupled to a control electrode of the third switching element for rendering the third switching element alternatingly conductive and non-conductive with frequency f and thereby generating an AC ignition voltage over the resonant capacitive element.

2. Circuit arrangement as claimed in claim 1, wherein the circuit arrangement is further equipped with an auxiliary power supply for supplying a second DC voltage, respective poles of the auxiliary power supply being coupled to respective main electrodes of the third switching element.

3. Circuit arrangement as claimed in claim 1, wherein the second inductive element comprises a transformer equipped with a primary winding that is coupled between the third switching element and an input terminal and a secondary winding coupled in series with the terminals for lamp connection.

4. Circuit arrangement as claimed in claim 1, wherein a part of the second inductive element is part of a filter comprised in the circuit arrangement.

5. Circuit arrangement as claimed in claim 1, wherein the first and second switching elements either comprise a diode or are each shunted by a diode, wherein the DC-AC converter comprises a half bridge circuit and the first control circuit is equipped with means for alternatingly at a low frequency operating the circuit arrangement in a first and a second operating state, wherein in the first operating state the first switching element is rendered conductive and non-conductive at a high frequency while the second switching element is maintained in a non-conductive state, and wherein in the second operating state the second switching element is rendered conductive and non-conductive at a high frequency while the first switching element is maintained in a non-conductive state.

6. Circuit arrangement as claimed in claim 1, wherein the DC-AC-converter comprises a full bridge circuit equipped with a second series arrangement of a fourth and a fifth switching element that is coupled between the input terminals, wherein and equipped with means comprised in the first control circuit coupled to control electrodes of the fourth and fifth switching element, for controlling the conductive state of the fourth and fifth switching element, and wherein the first control circuit is equipped with means for alternatingly at a low frequency operating the circuit arrangement in a first or a second operating state, wherein in the first operating state one of the switching elements in each of the series arrangements is maintained non-conductive while of the two remaining switching elements one is maintained conductive and the other is rendered conductive and non-conductive at a high frequency, and wherein in the second operating state one of the switching elements that were non-conductive in the first state is maintained conductive while the other is rendered conductive and non-conductive at a high frequency and the other two switching elements are maintained non-conductive, and wherein the switching elements, that are in series with those switching elements that are operated at a high frequency in one of the operating states, either comprise a diode or are each shunted by a diode.

7. Circuit arrangement as claimed in claim 1, wherein the frequency of the AC ignition voltage is equal to f.

8. Circuit arrangement as claimed in claim 1, wherein the frequency of the AC ignition voltage is n*f, wherein n is a natural number bigger than or equal to 2.

9. Circuit arrangement as claimed in claim 1, wherein the amplitude of the AC ignition voltage is constant.

10. Circuit arrangement as claimed in claim 1, wherein the amplitude of the AC ignition voltage has a maximum value and is always bigger than half the maximum value.

11. Circuit arrangement as claimed in claim 1, wherein the second control circuit is equipped with means for detecting the end of the take over phase of the high pressure discharge lamp.

12. Circuit arrangement according to claim 11, wherein the means for detecting the end of the take over of the high pressure discharge lamp comprise means for determining whether the lamp voltage has been higher than a predetermined value in a predetermined time interval.

* * * * *